United States Patent [19]

Bessho

[11] Patent Number: 4,987,398

[45] Date of Patent: Jan. 22, 1991

[54] MULTILAYERED EDDY CURRENT TYPE POWER-SAVED INTENSE AC MAGNETIC FIELD GENERATOR

[75] Inventor: Kazuo Bessho, Hashiba, Japan

[73] Assignee: Kanazawa University, Kanazawa, Japan

[21] Appl. No.: 470,767

[22] Filed: Jan. 26, 1990

[30] Foreign Application Priority Data

Jan. 31, 1989 [JP] Japan ..... 1-19431

[51] Int. Cl.[5] ..... H01F 3/00; H01F 5/00

[52] U.S. Cl. ..... 335/299; 335/210; 335/296; 335/209

[58] Field of Search ..... 335/210, 296, 299, 209, 335/297, 250, 243, 100, 99, 101, 102, 245

[56] References Cited

PUBLICATIONS

IEEE Trans. on Magnetics, vol. MAG-20, No. 5, Part 2, Sep. 1984, pp. 1810–1812, "A Small Size 7 Tesla Flux Concentrator of Modular Construction Fed By a Small Thyristor Pulse Generator", Page 1810.

*Primary Examiner*—Leo P. Picard
*Assistant Examiner*—Trinidad Korka
*Attorney, Agent, or Firm*—Spencer & Frank

[57] ABSTRACT

A conventionally arranged multilayered eddy current type intense AC magnetic field generator is remarkably improved only by intercrossing frame-shaped iron cores with alternately multilayered structure of exciting coils and conductor plates for inducing eddy currents, so as increase the impedance of the exciting coils as well as to increase the mutual inductance thereof with the conductor plates. As a result, the desired intense AC magnetic field can be efficiently and continuously generated with evidently reduced electric power.

4 Claims, 9 Drawing Sheets

MULTILAYERED EDDY CURRENT TYPE POWER-SAVED INTENSE AC MAGNETIC FIELD GENERATOR

BACKGROUND OF THE INVENTION

1. Field of the Invention

The present invention relates to a multilayered eddy current type power-saved intense AC magnetic field generator in which an intense AC magnetic field is generated by concentrating eddy currents induced in secondary conductors through alternately multilayered structure of exciting coils and secondary conductors, more particularly, to that improved for facilitating further reduction of exciting electric power required for obtaining an extremely intense continuous AC magnetic field.

2. Description of Prior Art

The generation and the application of the intense magnetic field are required for the search of material properties in the intense magnetic field, the development of manufacturing materials, the study of nuclear fusion and the like, and hence the research thereof is strongly progressed in many countries by employing large-scaled arrangements as a national project.

However, almost all of the intense magnetic fields conventionally studied and practiced belong to DC magnetic fields and pulse magnetic fields, superconductor coils being employed for generating the former, while coils, through which discharge currents of charged capacitor banks flow, are employed for generating the latter.

In contrast thereto, for the intense AC magnetic field, any other effective and promising generator than the multilayered eddy current type intense AC magnetic field generator developed by the present inventor can not have been obtained. In other words, conventional intense AC magnetic field generators are mainly provided by employing an AC electro-magnet, in an air gap of which the intense magnetic field is obtained, except the present inventor's outcome.

What is worse, in the magnetic field generator of this type employing the AC electro-magnet, the AC magnetic field less than 2 Teslas can be readily obtained, while it is difficult to realize any further intense AC magnetic field by supplying any larger AC current in the coreless state caused by the saturation based thereon of the iron core.

On the other hand, a sufficiently intense AC magnetic field can be obtained by the multilayered eddy current type intense AC magnetic field generator developed by the present inventor. However, it is expected to realize any further higher efficiency according to the reduction of the exciting electric power required therefor, and hence it has been regarded as a task.

SUMMARY OF THE INVENTION

An object of the present invention is to accomplish the above task according to the improvement being common to various kinds of multilayered eddy current type intense magnetic field generators previously developed by the present inventor, and consequently to provide a multilayered eddy current type power-saved intense AC magnetic field generator, in which an intense AC magnetic field can be continuously generated at room temperature with a high efficiency based on the further reduction of power consumption.

The intense AC magnetic field generator of this kind conventionally developed is formed such that AC magnetic fluxes are generated by supplying an AC current to the exciting coil and hence eddy currents are induced in multilayered or laminated secondary conductors.

In contrast thereto, the magnetic field generator of this kind according to the present invention is formed such that frame-shaped iron cores, which are formed as closed magnetic circuits surrounding cross-sections of alternately multilayered exciting coils and secondary conductors, are additionally provided, so as to reduce exciting currents through the increased impedance of exciting coils and hence to further improve the efficiency of the magnetic field generation with the small power consumption resulted by concentrating eddy currents individually induced in multilayered secondary conductors around the central hole, in which magnetic fluxes of high density are converged.

In other words, the multilayered eddy current type power-saved intense AC magnetic field generator of the present invention is featured by comprising a plurality of layers of exciting coils mutually engaged in coaxial state and wound with the same polarity, a plurality of layers of conductor plates alternately stacked between each layers of said exciting coils and provided commonly with slits passing through to the outskirts from central holes axially formed at central portions of said conductor plates including a connecting conductor plate provided in common with said conductor plates except said slits and hollows formed in the vicinities of said central holes and passing through with each other, and a plurality of frame-shaped magnetic materials which are formed as closed magnetic circuits surrounding cross-sections of a plurality of alternate layers of said exciting coils and said conductor plates through said hollows, so as to generate an axial-directioned intense AC magnetic field in said central holes by concentrating eddy currents induced in said conductor plates in the vicinities of said conductor plates in the vicinities of said central holes along said slits by supplying an AC current to said exciting coils and to reduce the required exciting currents through the impedances of said exciting coils which are increased by said closed magnetic circuits.

As a result, according to the present invention, the efficiency of electric power required for generating the magnetic field of the multilayered or laminated eddy current type intense AC magnetic field generator can be extremely increased only by additionally providing frame-shaped iron cores to the magnetic field generator concerned and the application field thereof can be expanded to electromagnetic pumps used for circulating the cooling sodium material in the high speed breeder reactor and for conveying the molten metal and the like further than the intense AC or pulse magnetic field generator conventionally used for the search of material properties, the development of manufacturing materials, the study of biomagnetics and the like.

BRIEF DESCRIPTION OF THE DRAWINGS

For better understanding of the invention, reference is made to the accompanying drawings, in which.

Figure 1:
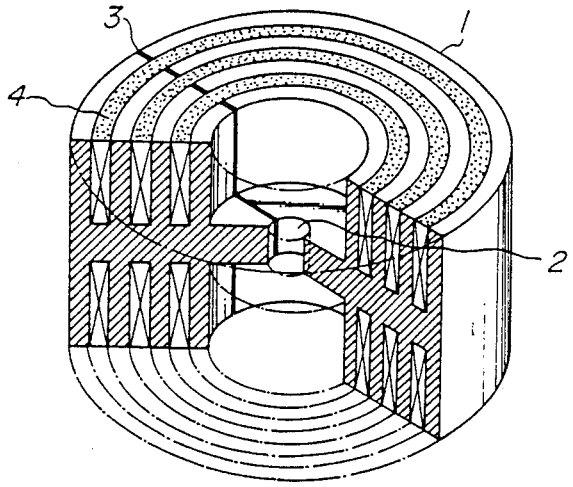
FIG. 1 PRIOR ART
FIG. 1 is a perspective view showing the structure of the conventional multilayered eddy current type intense AC magnetic field generator.

Throughout different views of the drawing, the following symbols are used.

1: cylindrical conductor
2, 9: hole
3, 10: slit
4: exciting coil
5, 11: hollow
6, 12, 12*u*, 12*v*, 12*w*: frame-shaped iron core
7: spiral coil
8: circular.rectangular conductor plate
u, v, w: three phase voltage vector
$u_0$–$u_2$, $v_0$–$v_2$, $w_0$–$w_2$: block Embodiments of the present inVention will be described in detail by referring to the drawings hereinafter.

The objects of the improvement according to the present invention, that is, structures of "a multilayered eddy current type intense AC magnetic field generator" as described in U.S. Pat. No. 4,855,703 issued Aug. 8, 1989 and "a laminated eddy current type coil for generating intense AC magnetic field" as described in U.S. Pat. No. 4,933,657 issued June 12, 1990, which have been proposed by the present inventor, are shown in FIGS. 1 and 2 respectively.

Embodiments 1 and 2 of the present invention, in which the performances of these magnetic field generators are remarkably improved only by adding iron cores thereto will be described successively hereinafter.

EMBODIMENT 1

Figure 2:
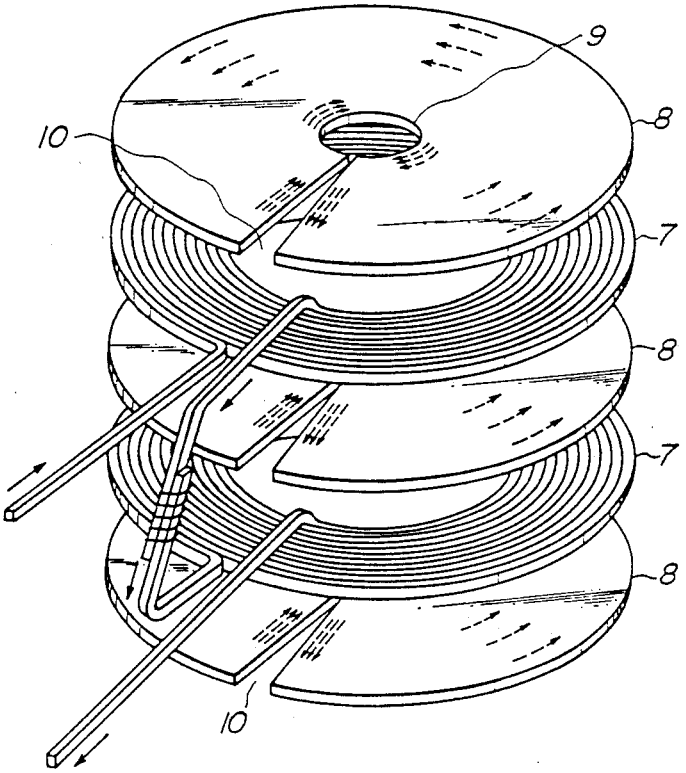
FIG. 2 PRIOR ART
FIG. 2 is a perspective view showing the structure of the conventional laminated eddy current type coil for generating the intense magnetic field.

In the conventional structure as shown in FIG. 1, a multilayered cylindrical conductor 1 is provided with a hole 2 at the center thereof, and further provided with a slit 3 which is radially extended from the central hole 2, and each layers of a multilayered exciting coil 4 are arranged between each layers of the multilayered conductor 1. In this conventional structure, when the exciting coil 4 is supplied with a current by a voltage applied thereto, eddy currents in the circumferential direction are induced in stratified conductors and then turn toward the central portions thereof along the radial slits 3, so as to be concentrated around the central holes 2. Magnetic fluxes generated by those circulating eddy currents are converged in the holes 2, so as to form high density magnetic fluxes, and, as a result, an intense AC magnetic field is continuously generated.

Figure 3:
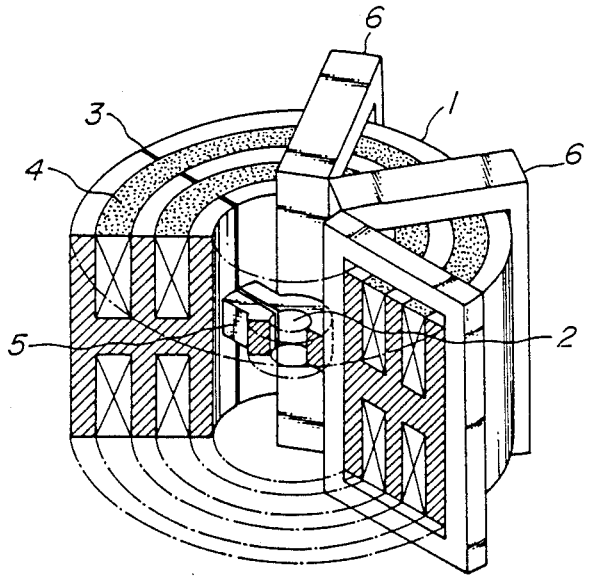
FIG. 3 is a perspective view showing an example of the structure of the multilayered eddy current type power-saved intense AC magnetic field generator according to the present invention.
Figure 4:
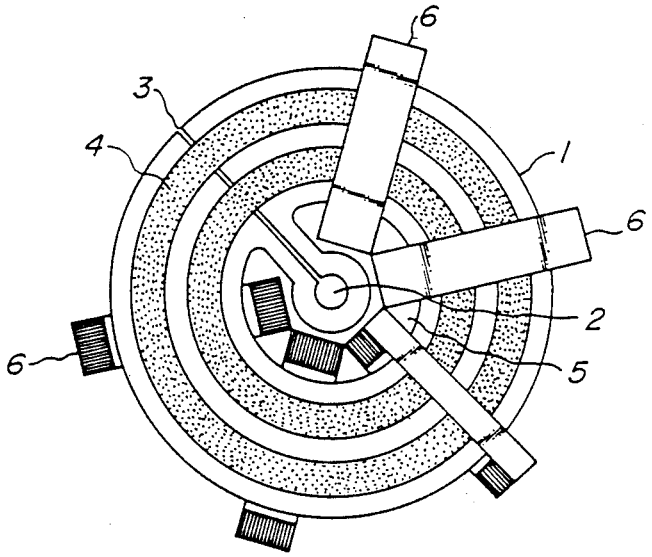
FIG. 4 is a plan showing the example of the same.

As to Embodiment 1 in which the present invention is applied to the above mentioned conventional structure, a perspective view thereof is shown in FIG. 3, while a plan thereof is shown in FIG. 4. In this embodiment as shown in these drawings, as to the multilayered cylindrical conductor 1 being just the same to that as shown in FIG. 1, the central portion being common to each layers thereof and surrounding the central hole 2 is hollowed out except a portion forming the slit 3, so as to form a substantially doughnut-shaped hollow 5, through which plural frame-shaped iron cores 6 are radially arranged. These radially arranged and equally spaced frame-shaped iron cores 6 individually form closed magnetic circuits respectively surrounding radial cross-sections of alternate multilayers which consist of exciting coil 4 and circumferential portions of the conductor 1.

In the embodiment as shown in FIGS. 3 and 4, five frame-shaped iron cores 6 consisting of cut cores are arranged in radial symmetry.

EMBODIMENT 2

In the conventional structure as shown in FIG. 2, plural spiral coils 7 and plural circular conductor plates 8, each of which has a central hole 9 and a fan-shaped slit 10 extending therefrom in the radial direction, are alternatively stacked. When the spiral coils 7 successively connected with each other are supplied with an AC voltage so as to flow an AC current, eddy currents in the circumferential direction are induced in the peripheral portions of the circular conductor plates 8 and then turn along the slits 10 in the radial direction, so as to be concentrated around the central holes 9. As a result, an intense AC magnetic field is continuously generated similarly as in the conventional structure as shown in FIG. 1.

Figure 5:
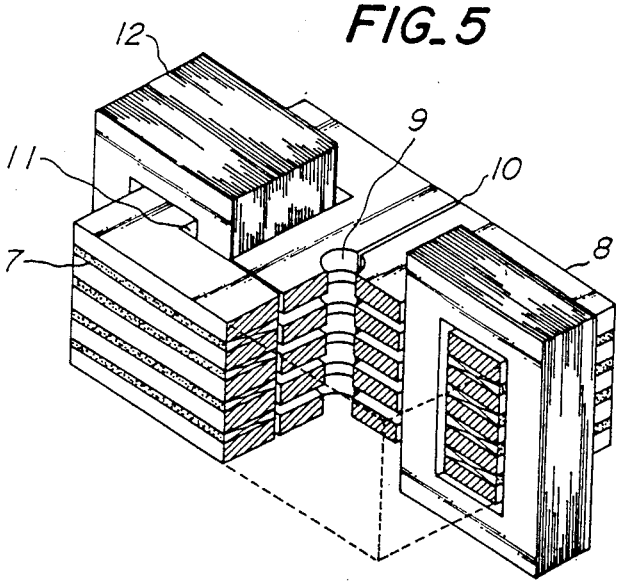
FIG. 5 is a perspective view showing another example of the same.
Figure 6:
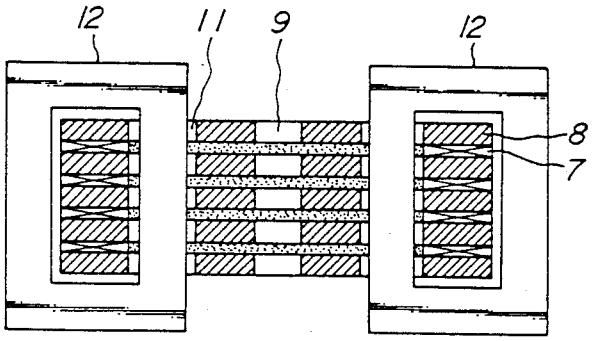
FIG. 6 is a vertical cross-section showing the other example of the same.
Figure 7:
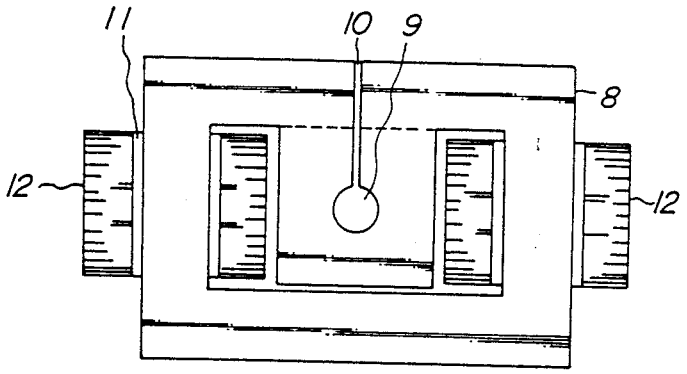
FIG. 7 is a plan showing the other example of the same.

As to the Embodiment 2 in which the conventional structure as shown in FIG. 2 is improved by applying the present invention, a perspective view is shown in FIG. 5, a vertical cross-section being shown in FIG. 6, and a plan being shown in FIG. 7. In this embodiment, conductor plates 8 consisting in an alternately multilayered structure of spiral coils 7 and rectangular conductor plates 8, which are different from circular shape as shown in FIG. 2, but are alternately stacked similarly as shown in FIG. 2, are hollowed out around the central holes 9 except the portions forming the slits 10, so as to form a hollow 11 by connecting rectangular hollows on the left side and the right side with each other. Frame-shaped iron cores 12 are arranged on the left and the right sides through these rectangular hollows 11, so as to form a closed magnetic circuit surrounding cross-sections of the alternately multilayered structure consisting of circumferential portions of spiral coils 7 and the rectangular conductor plates 8 in just the same manner as shown in FIG. 4.

Figure 8:
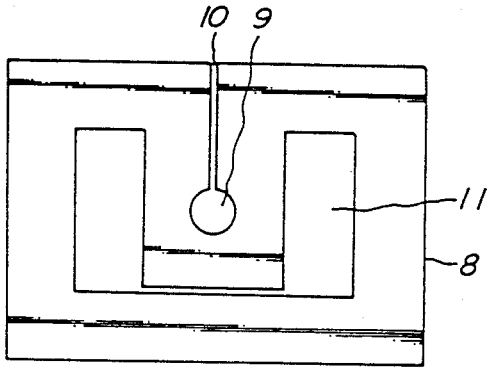
FIG. 8 is a plan showing the structure of a rectangular conductor plate in the other example of the same.
Figure 9:
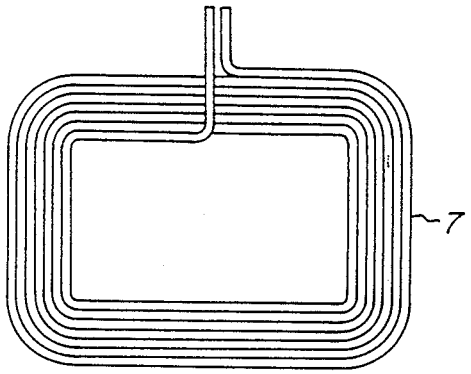
FIG. 9 is a plan showing the structure of a spiral coil in the other example of the same.

In this connection, a plan of the rectangular conductor plate 8 is shown in FIG. 8, while a plan of the spiral coil 7 is shown in FIG. 9.

In the example as shown in FIGS. 3 and 4 of the multilayered eddy current type power-saved intense AC magnetic field generator of the present invention, when the exciting coil 4 is supplied with an AC current, according to the function of the frame-shaped magnetic material, for instance, the frame-shaped iron core 6, which consists preferably of magnetic material having the low saturated flux density and forms a closed magnetic circuit, the impedance of the exciting coil 4 is increased and hence the exciting current is decreased on the same applied voltage, while the mutual inductance between the exciting coil 4 and the secondary conductor 1 is increased. As a result, the input exciting electric power required for generating just the same intense AC magnetic field in just the same hole 2 as in the conventional structure can be reduced, for instance, less than one half.

Figure 10:
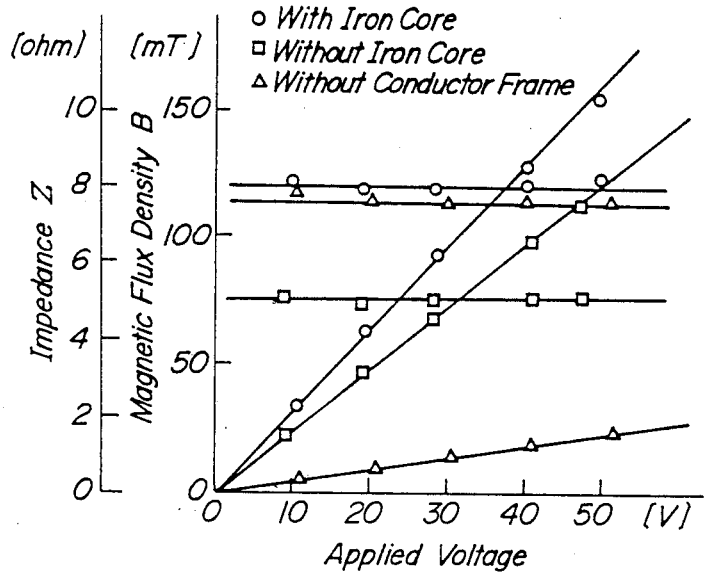
FIG. 10 is a characteristic curve showing an applied voltage vs. exciting impedance and magnetic flux density property of the example as shown in FIG. 3.

In FIG. 10, the variation characteristic of the exciting impedance Z and the magnetic flux B upon the variation of applied voltage in the intense AC magnetic field generator of the present invention, which is experimentally produced according to the structure as shown in FIG. 3, is indicated by marks O, that of the conventional generator arranged as shown in FIG. 1 being indicated by marks □ for comparison, further more that in case only of the exciting coil 2 combined without the cylindrical conductor 1 being indicated by marks Δ. As is apparent from the comparison between the various characteristics as shown in FIG. 10, in comparison with the characteristic as indicated by the marks □ of the conventional structure as shown in FIG. 1, the characteristics of the magnetic flux density (B) and the exciting impedance (Z) of the structure in which the iron core 6 is added as shown in FIG. 3 according to the present invention are remarkably raised upon the same applied voltage, and hence the necessary exciting current is reduced, so as to evidently improve those characteristics.

On the other hand, in the structure as shown in FIG. 5, in which the iron core 12 is similarly added also according to the present invention, when the exciting coil 7 is applied with the AC voltage, the impedance of the exciting coil 7 is raised by the function of the iron core 12, so as to reduce the exciting current. As a result, the exciting electric power required for generating the intense AC magnetic field in the same hole 9 can be remarkably decreased.

The functional effect of the present invention as mentioned above is due to the intercrossing of the frame-shaped iron core with the exciting coil, so that just the same improvement of property can be attained in the aforesaid embodiments 1 and 2.

In contrast with these embodiments 1 and 2 in which the frame-shaped iron core is added to the intense AC magnetic field generator as arranged just the same or substantially the same to the conventional structure, the embodiment 3 of the present invention, which is made as suitable to be used, for instance, as the electromagnetic pump for conveying molten metal, by modifying more or less the arrangement of constituents in the embodiment 2 as shown in FIGS. 5 to 8, will be described hereinafter.

EMBODIMENT 3

Figure 11:
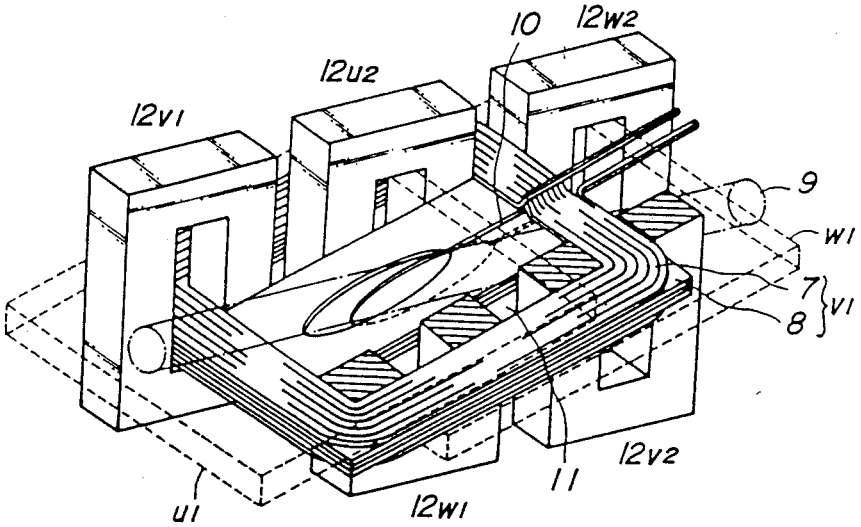
FIG. 11 is a perspective view showing still another example of the same.

The arrangement of the embodiment 3 as shown in FIG. 11 is made by dividing the alternately multilayered structure of the spiral coils 7 and the rectangular conductor plates 8 in the arrangement of the embodiment 2 as shown in FIG. 5, several layers by several layers, for instance, five layers by five layers in the example as shown in FIG. 11, such as each block is formed of those five layers. Moreover, successive three blocks $u_1$, $v_1$, $w_1$ are divided into one group in correspondence to the AC three phases, and, in the state such as the layers in each block are appropriately inclined, each one pair of frame-shaped iron cores $\mathbf{12}_{u1}$, $\mathbf{12}_{u2}$; $\mathbf{12}_{v1}$, $\mathbf{12}_{v2}$; $\mathbf{12}_{w1}$, $\mathbf{12}_{w2}$ are obliquely intercrossed with diagonal corners of rectangular coils respectively belonging to each blocks $u_1$, $v_1$, $w_1$ corresponding to each phases u, v, w of the AC three phases, in each group and further a pipe for conveying molten metal is made to relatively obliquely pass through the central holes 9.

Figure 12:
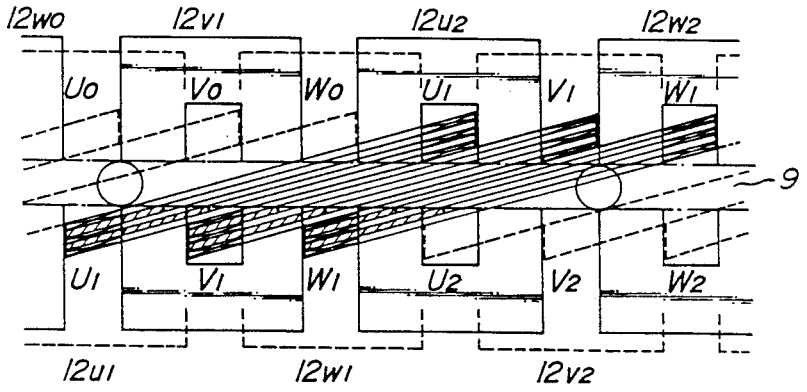
FIG. 12 is a vertical cross-section showing the still other example of the same.

A vertical cross-section along the axis of the holes 9 in the above mentioned arrangement is shown in FIG. 12. In this vertical cross-section, among each groups $u_0$, $v_0$, $W_0$, $u_1$, $v_1$, $w_1$, $u_2$, $v_2$, $w_3$, . . . respectively consisting of successive three blocks, the group of blocks $u_1$, $v_1$, $w_1$ only is indicated by solid lines, and the intercrossing area between the holes 9 and each blocks $u_1$, $v_1$, $w_1$ obliquely intercrossed with the axis of the holes 9 is appropriately elongated in comparison with the arrangement as shown in FIG. 5 in which those blocks $u_1$, $v_1$, $w_1$ are rectangularly intercrossed with the axis of the holes 9.

Figure 13:
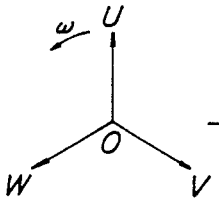
FIG. 13 is a vector diagram showing a three-phase applied voltage.
Figure 14:
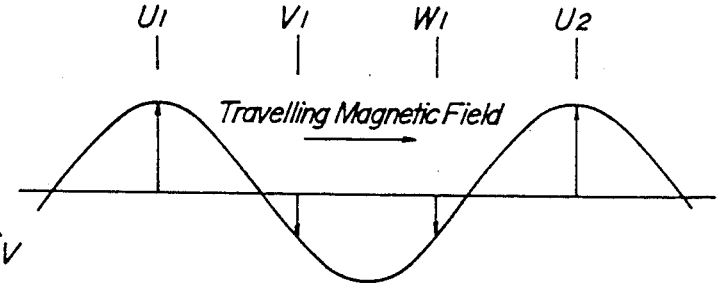
FIG. 14 is a waveform diagram showing an example of the traveling magnetic field in the example as shown in FIG. 11.

So that, when the three phase magnetic excitation is effected upon the successive three blocks u, v, w in each group of the arrangement as mentioned above by successively applying the three phase AC voltage u, v, w having the angular velocity $\omega$ as shown in FIG. 13 thereupon, the continuous traveling magnetic field as shown in FIG. 14 is generated in the pipe arranged in the holes 9, and hence, in case the pipe is fulfilled with molten metal, the induced current flows in this molten metal, and, as a result, the molten metal is effected by a thrust, so as to convey the molten metal through the pipe.

Figure 15:
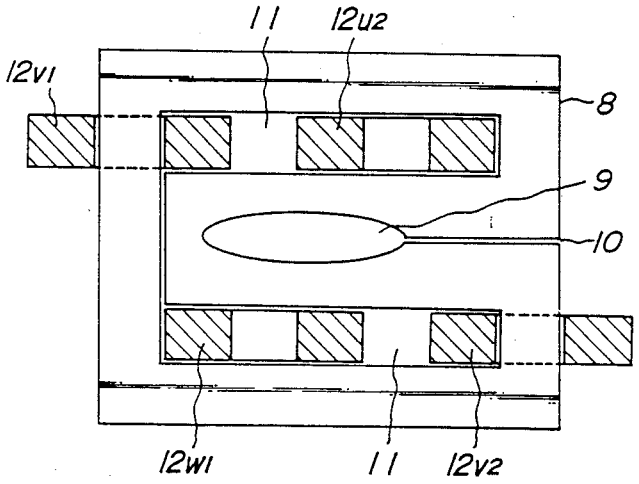
FIG. 15 is a plan showing the example as shown in FIG. 11.
Figure 16:
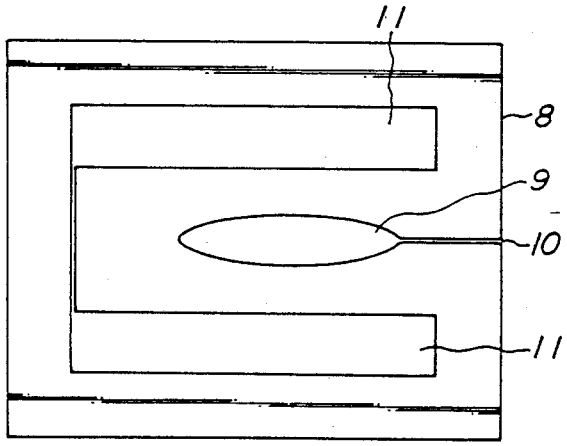
FIG. 16 is a plan showing the structure of a rectangular conductor plate in the example as shown in FIG. 11.
Figure 17:
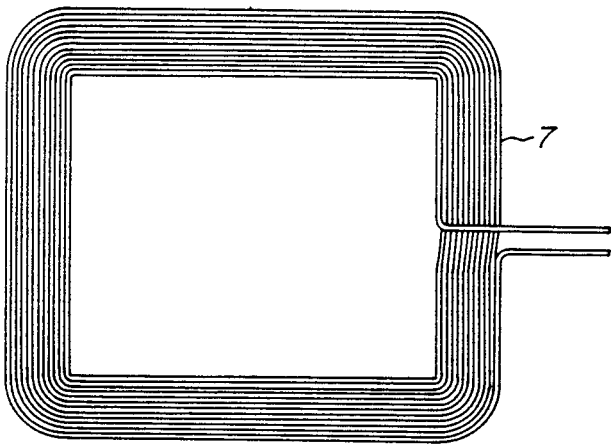
FIG. 17 is a plan showing the structure of a spiral coil in the example as shown in FIG. 11.

In this connection, FIG. 15 shows the plan of the uppermost rectangular conductor plate 8 for eddy current in each groups, the cross-sections of the pair of frame-shaped iron cores $\mathbf{12}_{v1}$, $\mathbf{12}_{v2}$ intercrossed with diagonal corners of the block $v_1$ corresponding to the phase v of the AC three phases and one of frame-shaped iron core $\mathbf{12}_{w1}$ intercrossed with the block $w_1$ corresponding to the phase w thereof in the group concerned and further the other frame-shaped iron core $\mathbf{12}_{u2}$ intercrossed with the block $u_2$ corresponding to the phase u thereof in the adjacent group, FIG. 16 showing the plane of the lowermost rectangular conductor plate 8 for eddy current in the group concerned, and FIG. 17 showing the plane of the exciting spiral coil 7. As is apparent from the comparison between FIGS. 15 and 16, the hole 9 as shown in FIGS. 15 and 16, which is obliquely intercrossed with the axial direction of the holes 9 as shown in FIG. 11, has a shape of ellipse and besides the bored positions thereof are successively shifted between the uppermost and the lowermost layers in each group. Moreover, as is apparent from FIG. 15, each block respectively corresponding to each phase of the AC three phases, for instance, the block $v_1$ corresponding to the phase v is intercrossed only with the frame-shaped iron cross $12_{v1}$, $12_{v2}$ corresponding the phase v concerned, while the block $v_1$ concerned is not intercrossed with the frame-shaped iron cores $12_{u2}$ and $12_{w2}$ corresponding to the other phases u and w respectively.

As is apparent from the above description, according to the present invention, it is effected only by intercrossing the frame-shaped iron cores with the alternately multilayered structure of exciting coils and conductor plates for eddy current in the conventionally arranged multilayered eddy current type intense AC magnetic field generator to increase the impedance of the exciting coils, as well as to increase the mutual inductance thereof with the secondary conductors. As a result thereof, the desired intense AC magnetic field can be efficiently and continuously generated with small electric power and hence the following evident effects can be obtained.

(1) Regardless of the difference between the DC and the AC magnetic fields, a large exciting current is generally required for generating an intense magnetic field. However, according to the present invention, it can be effected by concentrating the eddy currents around the central hole to effectively generate the intense AC magnetic field in the hole.

(2) For generating magnetic fluxes by the exciting AC current and hence generating eddy currents in the secondary conductor plates, it is effected by intercrossing the frame-shaped iron cores with the exciting coils to increase the exciting impedance and hence to decrease the exciting current. The functional effect thereof is not only to reduce the electric power required for generating the intense AC magnetic field, but also to suppress the temperature rise of the generator according to the reduction of exciting power.

(3) In the generation of the intense AC magnetic field, the insertion of the intercrossing iron cores is required for increasing the exciting impedance as well as for increasing the mutual inductance between the exciting coils and the secondary conductor plates, and further the saturated magnetic flux density of the intercrossing iron cores can be selected regardless of the desired intense AC magnetic field within the hole at all.

(4) The present invention presenting the above mentioned functional effects can be utilized not only for the intense AC magnetic field generator, but also, for instance, for the strong electromagnetic pump and the like by adding appropriate modifications to the arrangement thereof.

What is claimed is:

1. A multilayered eddy current type power-saved intense AC magnetic field generator comprising: a plurality of layers of exciting coils mutually engaged in coaxial state and wound with the same polarity, a plurality of layers of conductor plates alternately stacked between each layer of said exciting coils and provided commonly with slits passing through to the outskirts from central holes axially formed at central portion of said conductor plates including a connecting conductor plate provided in common with said conductor plates except said slits and hollows formed in the vicinities of said central holes and passing through with each other, and a plurality of frame-shaped magnetic materials which are formed as closed magnetic circuits surrounding cross-sections of a plurality of alternate layers of said exciting coils and said conductor plates through said hollows, so as to generate an axial-directioned intense AC magnetic field in said central holes by concentrating eddy currents induced in said conductor plates in the vicinities of said central holes along said slits by supplying an AC current to said exciting coils and to reduce the required exciting currents through the impedances of said exciting coils which are increased by said closed magnetic circuits.

2. A multilayered eddy current type power-saved intense AC magnetic field generator as claimed in claim 1 wherein said exciting coils and said conductor plates are formed in cylindrical shape and alternately stacked in coaxial form, the cylindrical conductor plates being connected by said connecting conductor plate at the middle portions thereof, the cylindrical exciting coils being divided into upper side and lower side portions by said connecting conductor plate.

3. A multilayered eddy current type power-saved intense AC magnetic field generator as claimed in claim 1 wherein said exciting coils and said conductor plates are formed in rectangular shape.

4. A multilayered eddy current type power-saved intense AC magnetic field generator as claimed in claim 3 wherein a plurality of alternately stacked layers of said exciting coils and said conductor plates is divided into each one blocks and further successive three blocks are divided into each one groups in correspondence to three phase AC in inclined state, said exciting coils in each block being obliquely intercrossed with a pair of said frame-shaped magnetic materials at diagonal corners thereof respectively.

* * * * *